US006062918A

United States Patent [19]

Myer et al.

[11] Patent Number: 6,062,918

[45] Date of Patent: May 16, 2000

[54] ELECTRICAL RECEPTACLE CONTACT ASSEMBLY

[75] Inventors: John Mark Myer, Millersville; Keith Robert Denlinger, Lancaster; John Raymond Shuey, Mechanicsburg, all of Pa.

[73] Assignee: The Whitaker Corporation, Wilmington, Del.

[21] Appl. No.: 08/878,559

[22] Filed: Jun. 19, 1997

Related U.S. Application Data

[60] Provisional application No. 60/021,166, Jul. 1, 1996.

[51] Int. Cl.[7] ..... H01R 4/48

[52] U.S. Cl. ..... 439/839; 439/833; 439/843

[58] Field of Search ..... 439/838, 839, 439/842–846, 850, 862

[56] References Cited

U.S. PATENT DOCUMENTS

| | | | |
|---|---|---|---|
| 3,659,243 | 4/1972 | Gluntz | 439/858 |
| 3,766,516 | 10/1973 | Appleton | 439/847 |
| 4,564,259 | 1/1986 | Vandame | 439/852 |
| 4,582,380 | 4/1986 | Wider et al. | 439/862 |
| 4,880,401 | 11/1989 | Shima et al. | 439/746 |
| 4,973,271 | 11/1990 | Ishizuka et al. | 439/839 |
| 5,158,485 | 10/1992 | Saito et al. | 439/843 |
| 5,186,664 | 2/1993 | Abe | 439/845 |
| 5,207,598 | 5/1993 | Yamada et al. | 439/636 |
| 5,226,842 | 7/1993 | Endo et al. | 439/843 |
| 5,246,390 | 9/1993 | Egenolf | 439/839 |
| 5,271,741 | 12/1993 | Saito et al. | 439/843 |
| 5,338,217 | 8/1994 | Saitoh et al. | 439/246 |
| 5,427,553 | 6/1995 | Tsuji | 439/851 |
| 5,441,428 | 8/1995 | Hamai et al. | 439/843 |
| 5,573,434 | 11/1996 | Ittah et al. | 439/839 |
| 5,810,627 | 9/1998 | Gierut et al. | 439/843 |

*Primary Examiner*—Steven L. Stephan
*Assistant Examiner*—Brian J. Biggi

[57] ABSTRACT

An electrical terminal 10 includes a female receptacle 20 and a separate reversely bent leaf spring member 40. The separate spring member 40 is formed from a material, such as stainless steel having a lower stress relaxation rate than materials normally used for electrical terminals. The separate spring member 40 has a stationary section 43 that is affixed to one wall of the female receptacle 20 and a leaf spring section 46 that provides a secondary spring backing up a primary spring 26 that is part of the female receptacle 26. The separate spring member 40 is inserted into the female receptacle 20 through a mating face 29 and is snapped to sidewalls 24. The separate spring member 40 deflects the primary spring 26 during insertion and the primary spring 26 does not return to its unstressed condition unless deflected by insertion of a male pin contact when mated.

17 Claims, 4 Drawing Sheets

ELECTRICAL RECEPTACLE CONTACT ASSEMBLY

This application claims the benefit of U.S. Provisional Application No. 60/021,166, filed Jul. 1, 1996.

BACKGROUND OF THE INVENTION

1. Field of the Invention

This invention is related to electrical terminals and is especially related to female electrical terminals that are matable with a male or pin terminal to form a disconnectable electrical connection between two electrical conductors. More specifically this invention is related to an electrical terminal in which a backup spring is used to support the connection to the mating male or pin terminal.

2. Description of the Prior Art

Although most prior art female electrical terminals are stamped and formed from a single member, some prior art female terminals do employ a composite structure in which a separate spring member is used to provide the spring force for engaging a mating male or pin terminal. Typical female terminals of this type employ a spring member of a highly resilient metal different from the material forming the remainder of the female terminal. An example of a terminal of this type is shown in U.S. Pat. No. 5,441,428, which discloses a terminal having a plate section disposed within a square or rectangular cylindrical contact portion. The plate section is bowed and is supported at its opposite ends by one wall of the cylindrical contact section. When a pin terminal is inserted the plate section is deflected and one free end of the plate section slides relative to the wall of the cylindrical contact on which the bowed plate section is supported. It appears that this separate resilient plate section provides most if not all of the contact force exerted on the mating pin or male terminal and therefore should provide the best electrical interface. Multiple electrical contacts must however be formed between this interface with the male terminal and the conductor to which the female terminal is attached.

Another approach for using dissimilar materials to form a composite female electrical terminal is shown in U.S. Pat. No. 5,246,390. In the terminal disclosed therein, a backup spring body is formed on the outside of contact spring arms that in turn extend from a wire termination portion of the two piece terminal. The outer backup spring body has a box shape with outer spring arms. To reduce insertion force when a mating tab is inserted, backup spring arms are held by spacing means at a minimum spacing from each other so that the contact spring arms come into abutment with the backup arms only after having been spread apart to a predetermined distance.

SUMMARY OF THE INVENTION

The female electrical terminal or receptacle contact assembly of the present invention employs a separate spring member to backup a primary spring member that is part of a one piece receptacle contact that includes a wire termination section. The primary spring member engages a mating male or pin terminal so that the electrical connection to both the mating pin terminal and to an external conductor, such as a wire, are formed by the same one-piece member. However a backup spring member, formed from a material having a lower stress relaxation rate, is used to increase the normal force contact and to maintain more stable electrical interface over the life of the terminal or the life of the electrical connection. The separate backup spring member is affixed to the outer female receptacle, which in the preferred embodiment has a generally rectangular cross section, and a leaf spring section is reversely bent relative to the portion of the spring that is affixed to the receptacle. This leaf spring section extends toward the mating face of the female receptacle.

The separate spring member is inserted into the female receptacle through the front or the mating face. Guide recesses which are formed by coining the terminal are aligned with windows on the sides of the female receptacle. The stationary section of the separate spring is inserted through these guide recesses and laterally protruding extensions snap into windows of the sidewalls of the female receptacle to affix the separate spring member intermediate the ends of this stationary spring section. The sidewalls of the female receptacle will be outwardly deflected to a small extent as the separate spring is inserted through the guide recesses. Lateral extensions on a trailing end of the separate spring member register with and are received in notches at the mating face of the female receptacle so that the separate spring member is secured to the female receptacle at two axially spaced locations. The leaf spring section of the separate spring member can then be deflected both relative to this stationary spring section and to the wall or surface of the female receptacle to which it is affixed.

When the separate spring member is inserted through the mating face, it deflects the primary leaf spring, which extends from one wall of the female receptacle toward the mating face. The separate spring member eventually snaps into place behind the primary spring member so that a mating male terminal will engage the primary spring member, although the separate backup spring will exert a normal force on this termination.

An electrical terminal including these features will have a number of advantages and will satisfy a number of practical objectives. Among these advantages and objectives are the following.

The normal force exerted at the mating interface will remain substantially constant over the life of the connection because the stress relaxation rate of the separate spring will be less than that of the primary spring, which is an integral portion of the female receptacle. In other words, the end of life contact normal force of the assembly will be of a relative high magnitude, and good electrical contact will be sustained.

Furthermore the assembly of the separate spring member is relatively easy, since it is inserted axially into the female receptacle with minimal deflection of the walls of the female receptacle. Therefore the final configuration of the female receptacle can be formed before the separate spring member is inserted, and there is no need for a subsequent forming step to close any seams on the receptacle. In other words all of the forming steps can be performed at one time, eliminating costly secondary operations. Also the spring insertion step need not be part of the forming operation, eliminating a costly manufacturing step.

The primary spring on the female receptacle can also be formed from one wall of the female receptacle without significant material waste and also reducing the height of the terminal assembly.

The separate spring member, which in the preferred embodiment is formed of stainless steel, also performs several secondary functions. For example, it supports opposite sidewalls of the female receptacle and provides good crush strength so that unnecessary damage to the terminals can be avoided. The separate spring member can also prevent stubbing when male contact pins are inserted through the mating face of the connector.

All of these and other advantages can be achieved in a terminal assembly that is relatively compact, since the reversely bent springs reduce the length of the overall contact.

DETAILED DESCRIPTION OF THE EMBODIMENT

Figure 1:
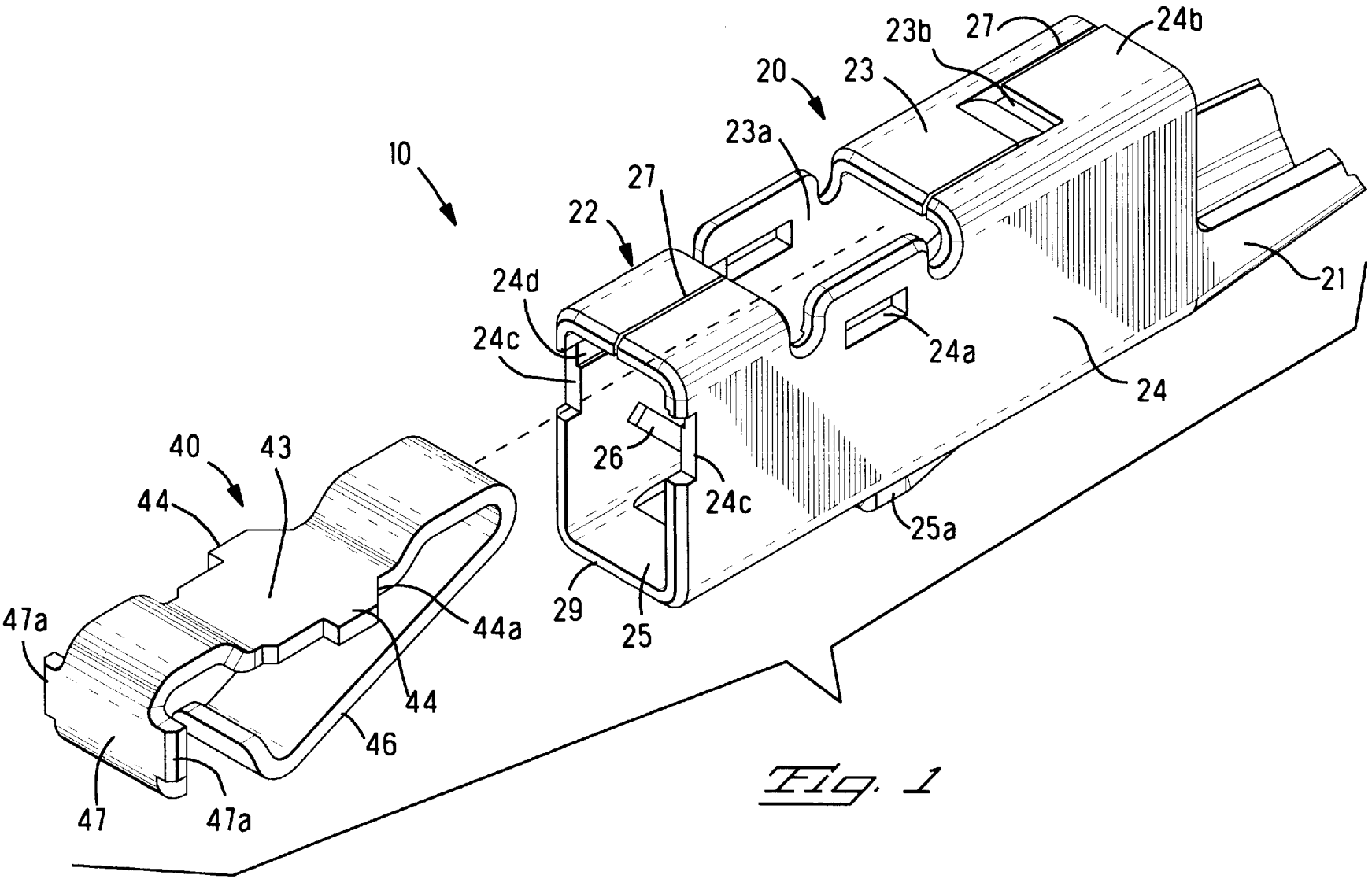
FIG. 1 is an isometric view of the receptacle contact assembly according to the present invention with a leaf spring exploded away from a receptacle contact.

Referring to FIGS. 1–4, the receptacle contact assembly 10 according to the present invention will be described. Receptacle contact assembly 10 includes a receptacle contact 20 and a leaf spring 40 insertable therein. Receptacle contact 20 is preferably formed of an inexpensive conductive material, for example, brass, and includes a wire termination section 21 for termination to a conductor and a pin insertion area 22. Pin insertion area 22 includes a top wall 23 with an open area 23*a* and a recess 23*b*, and sidewalls 24 each including a respective window 24*a*, notches 24*c*, and guide recesses 24*d* formed on the inside of the wall 24 by coining the surface thereof. An upper end of wall 24 includes a tab 24*b* for cooperating with a recess 23*b* adjacent to top wall 23, thereby forming an offset seam 27 between tab 24*b* and top wall 23. Pin insertion area 22 also includes a bottom wall 25 having an orientation projection 25*a* for cooperating with a respective groove formed in an electrical connector housing not shown in the drawing. The receptacle contact 20 further includes a primary spring 26 folded towards a mating face 29 of the contact 20 from an area adjacent top wall 23 and tab 24*b*.

Leaf spring 40 is preferably formed of a metal material having high spring characteristics and strength, for example, stainless steel. Leaf spring 40 comprises a plate 43 having locking sides 44 extending therefrom, each locking side includes a lead-in taper 44*a*, which tapers 44*a* are sized to be slideably received in guide recesses 24*d* of receptacle contact 20. Extending from plate 43 is a secondary spring 46 which is sized to be received in receptacle contact 20. A wall section 47 extends from an opposing side of plate 43 and includes extensions 47*a* for registering with notches 24*c* of receptacle contact 20.

Figure 2:
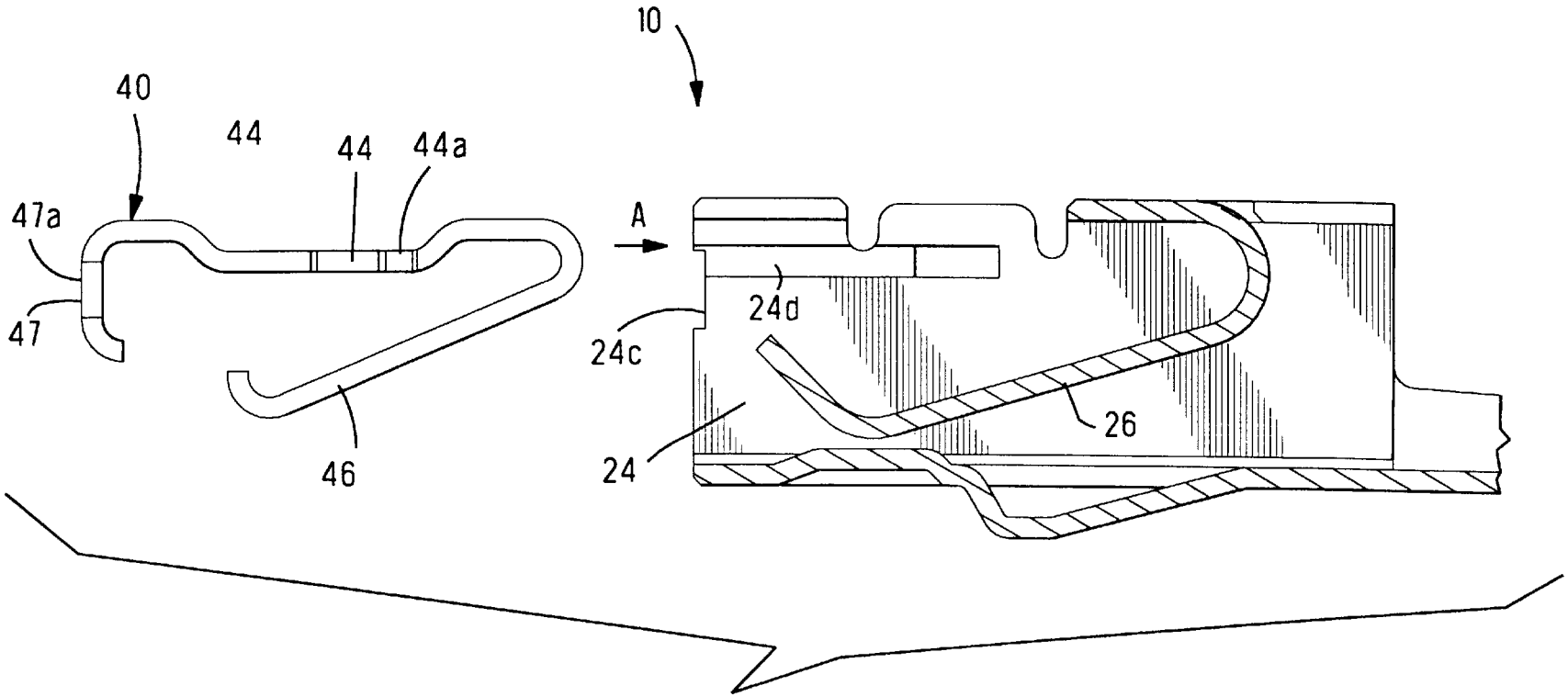
FIG. 2 is a side view of the leaf spring and a partial cross sectional view of the receptacle contact of FIG. 1.

Assembly of the receptacle contact assembly 10 will now be described. Referring to FIG. 2, the leaf spring 40 is first aligned relative to the receptacle contact 20 so that the secondary spring 46 can be inserted therein, in particular, locking sides 44 are aligned to be received in guide recesses 24*d* of contact 20. At this point, the leaf spring 40 is moved toward receptacle contact 20 in the direction of arrow "A" of FIG. 2, so that tapered lead-in areas 44*a* of locking sides 44 slideably press against guide recesses 24*d*, thereby forcing the receptacle contact 20 to open slightly at offset seam 27 against the natural spring tendency of receptacle 20.

Figure 3:
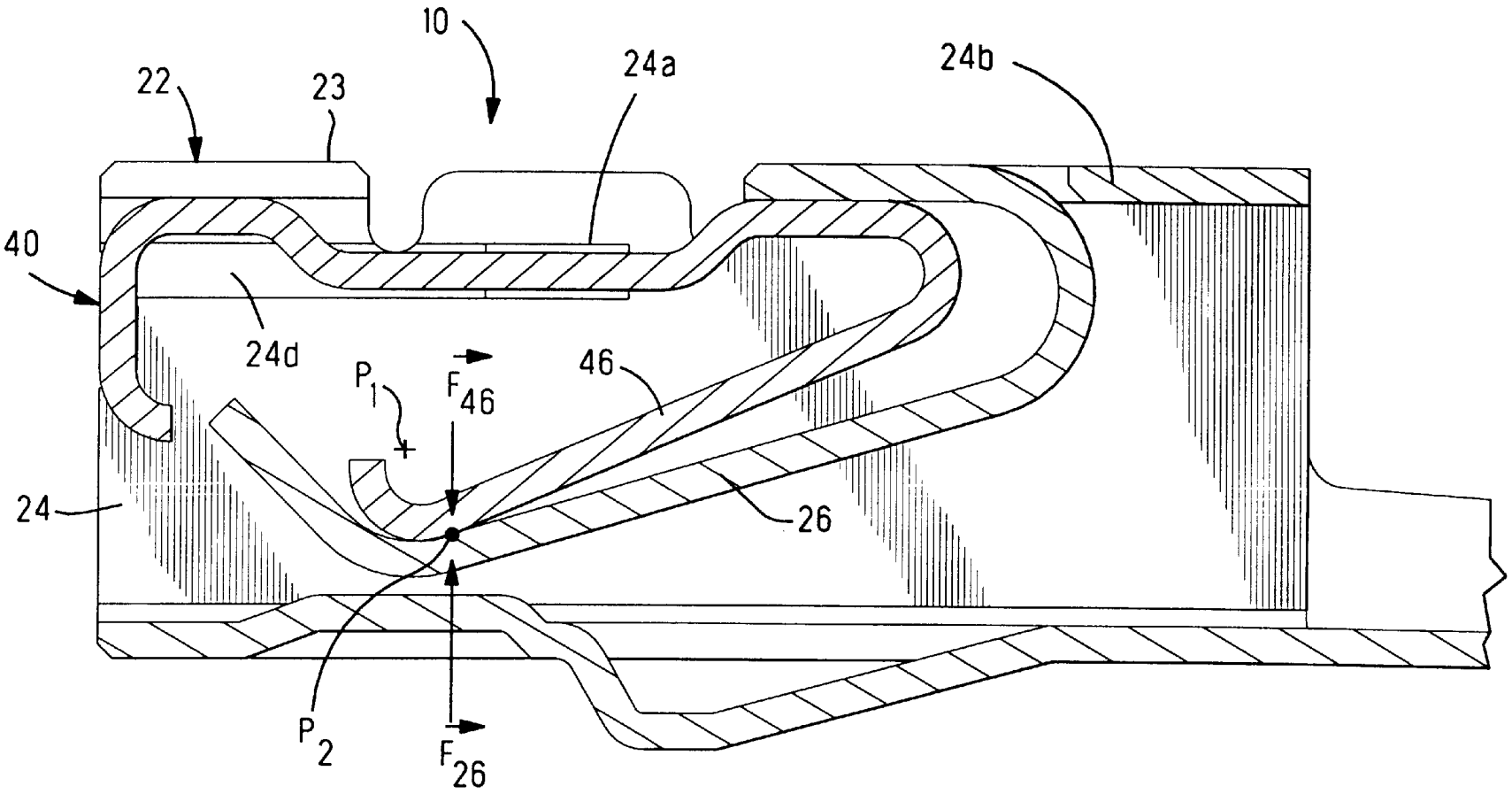
FIG. 3 is a cross sectional view of the receptacle contact assembly according to the present invention with the leaf spring installed in the receptacle.
Figure 4:
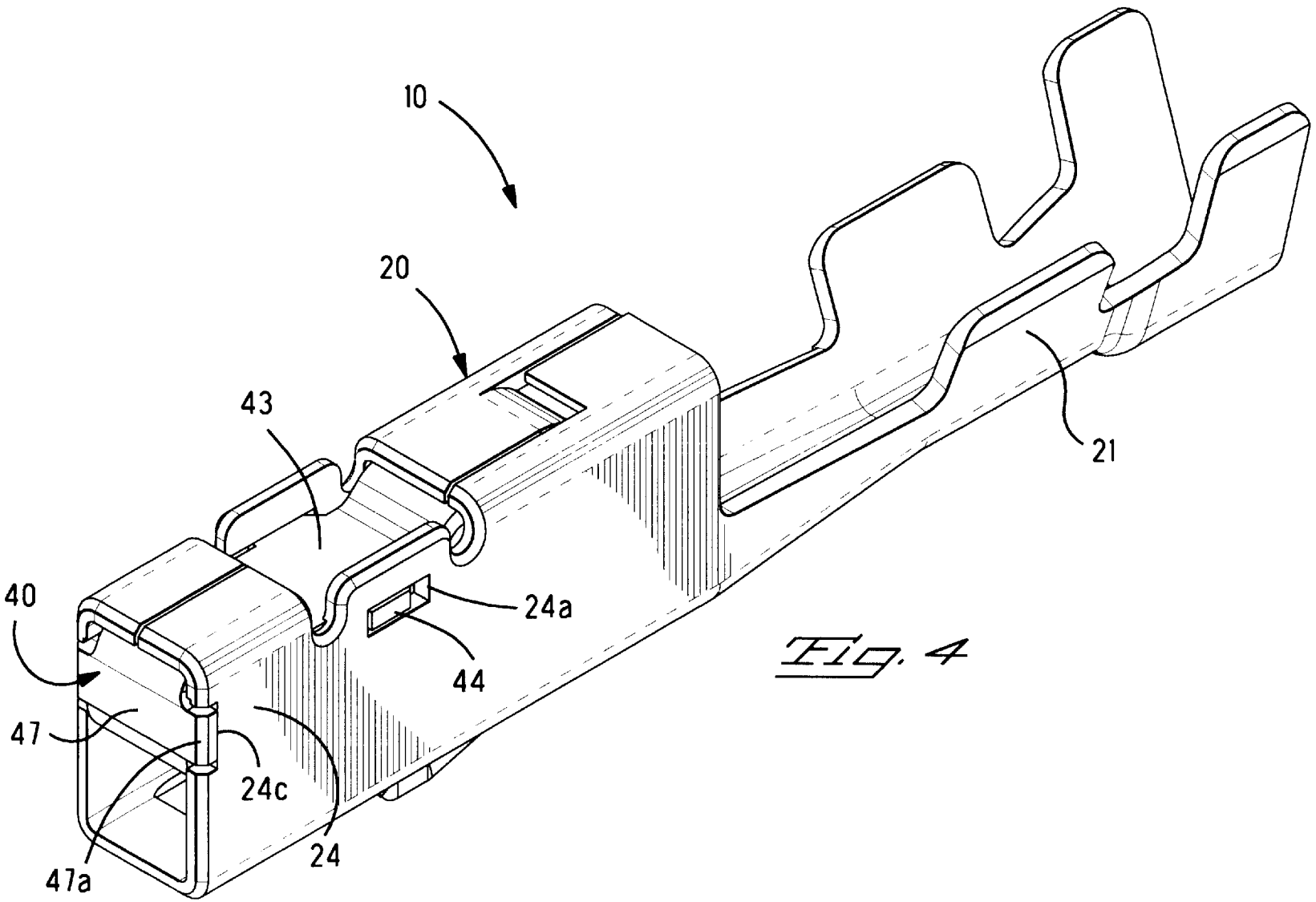
FIG. 4 is an isometric view of the receptacle contact assembly of FIG. 1 when it is in a fully assembled state.

When locking sides 44 reach respective windows 24*a* of contact 20, the locking sides will snap into place within the windows 24*a*, thus allowing the receptacle contact to resile back to its original state whereby offset seam 27 is essentially closed, as is best shown in FIG. 4. As leaf spring 40 is moved into receptacle contact 20, secondary spring 46 will be slid into place adjacent to primary spring 26, as shown in FIG. 3. Additionally, as shown in FIG. 4, notches 24*c* of receptacle contact 20 will respectively receive extensions 47*a* of leaf spring 40 thereby firmly retaining the leaf spring in place at the mating face of receptacle contact 20. Thus leaf spring 40 is trapped between the notches 24*c* and windows 24*a* of receptacle contact 20.

Referring to FIG. 3, secondary spring 46 is sized to pressingly engage primary spring 26 and thereby displace spring 26 from its original position P1, i.e. the unstressed position it assumed prior to the leaf spring's insertion in the receptacle contact. Primary spring 26 is therefore deflected downwardly by pressing engagement with secondary spring 46 so that the point of contact therebetween will comprise forces of equal magnitude but of opposing senses of direction, as indicated by vectors F26 and F46. Force vector F46 is pressing in a downward direction at point P2, and force vector F26 is pressing upwardly at the same point. As noted above, leaf spring 40 is preferably formed of a stainless steel material or other high strength material, and receptacle 20 is preferably formed of a lower strength material, e.g. brass or phosphorus-bronze material. The differential between these material strengths, and the beam geometries with respect to the larger radius and effective length of beam 26 relative to beam 46, result in different spring characteristics of the beams, i.e. the secondary spring 46 has a much higher spring characteristic than the primary spring 26. When a pin is inserted into the receptacle 20, both spring 26 and spring 46 will be deflected upwardly; however, in a preferred embodiment of the present invention, spring 26 will be deflected upwardly to the point of where its contact normal force on the pin inserted in contact 20 is nominal, or almost zero. However, the contact normal force generated by the deflection of spring 46 will be substantially greater, and secondary spring 46 will press on primary spring 26 and thereby provide the necessary contact normal forces for spring 26 to engage the pin and maintain electrical contact therewith.

The use of a high strength material with a low-stress relaxation rate to form a secondary spring is advantageous because the spring rate of secondary spring 46 will decay, i.e. due to stress relaxation, at a much lower rate, over the lifetime of the contact, than a spring formed of lower strength material having a high stress relaxation rate, e.g. brass. Therefore, the end of life contact normal force of the assembly 10 will be of a high magnitude, and good electrical contact will be sustained thereby.

Further advantages inhere in the foregoing embodiment. For example, open area 23*a* of top wall 23 advantageously allows the latching sides 44 of leaf spring 40 to snap into place in windows 24*a*, which facilitates assembly and eliminates the need to drop the leaf spring 40 into the top of the receptacle and then close the seam. Also, the use of guide recesses 24*d* and locking sides 44 facilitates assembly of the leaf spring 40 into the receptacle contact 20. Moreover, offset seam 27 advantageously permits beam 26 to be formed from top wall 23 without the need for overlapping stock material so that the overall height and production cost of the contact are reduced. Additionally, wall section 47 advantageously prevents stubbing of a pin contact when inserted in the receptacle contact 20. Furthermore, because extensions 47*a* of leaf spring 40 firmly fit into notches 24*c*, a good crush-strength resistance is imparted to the overall contact assembly 10, thereby eliminating the need for overlapping stock material at the top of the assembly 10.

Thus, while a preferred embodiment of the invention has been disclosed, it is to be understood that the invention is not be to strictly limited to such embodiment but may be otherwise variously embodied within the scope of the appended claims. The normal force exerted at the mating interface will remain substantially constant over the life of the connection because the stress relaxation rate of the separate spring will be less than that of the primary spring, which is an integral portion of the female receptacle. In other words, the end of life contact normal force of the assembly will be of a relative high magnitude, and good electrical will be sustained.

Furthermore the assembly of the separate spring member is relatively easy, since it is inserted axially into the female receptacle with minimal deflection of the walls of the female receptacle. Therefore the final configuration of the female receptacle can be formed before the separate spring member is inserted, and there is no need for a subsequent forming step to close any seams on the receptacle. In other words all of the forming steps can be performed at one time, eliminating costly secondary operations. Also the spring insertion step need not be part of the forming operation, eliminating a costly manufacturing step.

The primary spring on the female receptacle can also be formed from one wall of the female receptacle without significant material waste and also reducing the height of the terminal assembly.

The separate spring member, which in the preferred embodiment is formed of stainless steel, also performs several secondary functions. For example, it supports opposite sidewalls of the female receptacle and provides good crush strength so that unnecessary damage to the terminals can be avoided. The separate spring member can also prevent stubbing when male contact pins are inserted through the mating face of the connector.

We claim:

1. An electrical terminal comprising:

a female receptacle having an interior surrounded by outer walls and fronted by an open mating face, the female receptacle further comprising a primary spring extending toward the interior; and a separate spring member inserted through the open mating face and mounted on the interior of the female receptacle between the primary spring and an inner surface of one outer wall, the separate spring member including a first section affixed to the female receptacle adjacent to the inner surface, and a second section extending from the inner surface toward the interior of the female receptacle, the second section being deflectable with the primary spring relative to the first section and relative to the female receptacle to generate a mating force when a male contact member is inserted into the female receptacle, the second section being reversely formed relative to the first section to extend toward the mating face.

2. The electrical terminal of claim 1 wherein the separate spring member is formed from a material having a lower stress relaxation rate than the material from which the female receptacle is formed.

3. The electrical terminal of claim 2 wherein the separate spring member comprises a secondary spring positioned to support the primary spring formed from the female receptacle so that the primary spring engages a male member inserted into the female receptacle.

4. The electrical terminal of claim 3 wherein the secondary spring deflects the primary spring from the unstressed position occupied by the primary spring when the terminal is in an unmated condition.

5. The electrical terminal of claim 4 wherein the primary spring is deflected to a substantially unstressed position when the electrical terminal is mated with a male contact member with substantially all normal force exerted on the male contact being contributed by the secondary spring.

6. The electrical terminal of claim 1 wherein the first section is inserted through guide recesses on inner surfaces of the female receptacle outer walls.

7. The electrical terminal of claim 1 wherein the first section is affixed to the female receptacle at one end of the first section so that the separate spring member is affixed to the female receptacle at spaced positions.

8. The electrical terminal of claim 7 wherein lateral extensions on one end of the separate spring member are received within notches on the outer walls at the mating face of the female receptacle and in which lateral edges intermediate the ends of the first section are received within windows on female receptacle outer walls.

9. The electrical terminal of claim 1 wherein the separate spring member is insertable through the mating face into a position behind the primary spring, the primary spring being deflected during insertion of the separate spring member.

10. The electrical terminal of claim 9 wherein the primary spring is formed as a reversely bent section of a top wall of the female receptacle.

11. The electrical terminal of claim 1 wherein the separate spring member supports opposite outer walls of the female receptacle to provide crush resistance to the female receptacle.

12. The electrical terminal of claim 1 wherein the female receptacle and a wire termination section form a single continuous member.

13. The electrical terminal of claim 1 wherein the separate spring member comprises a leaf spring.

14. An electrical contact comprising:

a female receptacle having an interior surrounded by outer walls;

a primary leaf spring formed from one of the outer walls for contacting a mating pin contact;

a secondary leaf spring having a complementary contour to the primary leaf spring mounted on the interior of the female receptacle and located adjacent to the primary spring;

said leaf springs having a spring characteristic differential therebetween, with the secondary leaf spring contributing most of the normal force when a mating pin contact is moved into contact with the primary leaf spring.

15. The electrical contact of claim 14 wherein the spring characteristic differential between the primary and secondary leaf springs is such that substantially all of the normal force exerted on a mating pin contact is contributed by the secondary spring.

16. The electrical contact of claim 14 wherein the spring characteristic differential between the primary and secondary leaf springs is such that the primary spring is in a substantially unstressed condition when a pin contact is mated to the electrical contact.

17. The electrical contact of claim 14 wherein the secondary spring is formed of stainless steel and the primary spring is formed of a lower strength material.

* * * * *